United States Patent [19]

Kamo et al.

[11] Patent Number: 4,852,542

[45] Date of Patent: Aug. 1, 1989

[54] THIN THERMAL BARRIER COATING FOR ENGINES

[75] Inventors: Roy Kamo; Melvin E. Woods, both of Columbus, Ind.; W. Bryzik, Grosse Pointe Woods, Mich.

[73] Assignee: Adiabatics, Inc., Columbus, Ind.

[21] Appl. No.: 111,933

[22] Filed: Oct. 23, 1987

[51] Int. Cl.[4] ..... F02B 77/11; F02B 75/08

[52] U.S. Cl. ..... 123/668; 123/193 CH; 123/193 P; 123/188 AA; 123/193 H

[58] Field of Search ..... 123/193 R, 193 C, 193 CH, 123/193 CP, 193 H, 193 P, 270, 271, 668, 669, 188 AA; 60/687; 252/62

[56] References Cited

U.S. PATENT DOCUMENTS

| | | | |
|---|---|---|---|
| 3,919,755 | 11/1975 | Kaneko et al. | 60/687 X |
| 4,376,374 | 3/1983 | Bothwell | 60/687 |
| 4,495,907 | 1/1985 | Kamo | 252/62 X |
| 4,538,562 | 9/1985 | Matsui et al. | 123/669 X |
| 4,711,208 | 12/1987 | Sander et al. | 123/669 X |

*Primary Examiner*—Willis R. Wolfe
*Attorney, Agent, or Firm*—Baker & Daniels

[57] ABSTRACT

Thin thermal barrier coating of a specified thickness of 0.002 to 0.009 inch to insulate the combustion chamber of an internal combustion engine to achieve optimum reduction of transient head flow. The coating is of an optimum thickness to reduce in-cylinder heat loss in the combustion chamber during combustion, thus increasing engine efficiency, specific power output, and reducing emissions. However, the temperature increase is not so great as to adversely affect engine lubricant life or volumetric efficiency. The invention is particularly suitable for gasoline engines as it does not cause preignition or knocking that is generally caused by insulating coatings of greater thickness. In addition, the invention is particulalry suitable for aluminum combustion chamber components. The thinner coating also results in improved reliability and durability by reducing chipping and cracking failure tendencies associated with ceramic coatings.

8 Claims, 6 Drawing Sheets

CYLINDER WALL TEMPERATURE DURING A CYCLE

TRANSIENT THERMAL BARRIER THIN COAT ENGINE CHAMBER

INSULATED VS NON-INSULATED P-V DIAGRAM COMPARISON

INSULATED VS NON-INSULATE CYCLE TRANSIENT SURFACE TEMPERATURE COMPARISON

THIN THERMAL BARRIER COATING FOR ENGINES

GOVERNMENT RIGHTS

This invention was developed with Government support under Contract No. DAA E07-85-C-R166 awarded by the Department of Army. The government has certain rights in this invention.

FIELD OF THE INVENTION

The present invention relates to combustion chambers of internal combustion engines and, in particular to insulative coatings on the surfaces of such combustion chambers to increase the temperature of the chamber.

BACKGROUND

It is desirable to insulate the combustion chamber in an internal combustion engine to reduce heat loss, improve engine efficiency, improve emission quality, and maximize specific power output. One method to achieve this purpose is to apply an insulating ceramic coating to the combustion chamber defining components. A wide range of ceramics have favorable thermal barrier and thermal expansion characteristics, and may be easily applied by a variety of coating processes and modified to meet a wide range of functional requirements.

One known ceramic coating is a very thin layer from 0.0002 to 0.001 inch thick as described in U.S. Pat. No. 4,074,671. This patent teaches that even an extremely thin ceramic coating can increase combustion chamber temperature. However, coatings of such a thickness do not cause an increase in temperature sufficient to significantly enhance engine performance.

Much more popular are thicker ceramic coatings on the order of 0.020 to 0.110 inch, such as described in U.S. Pat. Nos. 4,419,971 and 4,495,907. It has been well recognized that these thicker coatings increase the cycle mean temperature of the combustion chamber. However, numerous and significant problems are caused by such thick coatings. Most importantly, thick coatings are unsuitable for gasoline engines because they raise the temperature of the fuel-air mixture to such a high level as to cause preignition, knocking, and breakdown of lubricants. Moreover, the volumetric efficiency of the engine is reduced due to the increased air or air-fuel temperature caused by heat transfer from the combustion chamber during the intake cycle. Finally, thick coatings tend to chip, crack and separate from their metal substrate due to the thermal expansion characteristics of the metal substrate, and low reliability associated with these coatings.

SUMMARY OF THE INVENTION

The present invention is a thin thermal barrier coating applied to a combustion chamber surface. The coating is on the order of 0.002 to 0.009 inch thick. This thickness is sufficient to adequately retain heat during the combustion stroke, thus increasing engine efficiency, and reducing heat loss and pollutants. However, the temperature of the combustion chamber during the remaining cycle is not so high as to cause preignition, accelerated lubrication breakdown or to reduce volumetric efficiency.

The present invention recognizes the heretofore unappreciated fact that the heat loss in a combustion chamber is caused by two distinct occurrences: (1) heat flow from the combustion gas through the surfaces of the combustion chamber; and (2) heat flow from the combustion chamber surfaces back to the incoming charge air or air-fuel mixture. Prior methods of measuring heat loss only focus on steady state one directional heat flow through the combustion chamber surfaces; hence the emphasis on thick insulative coatings of the combustion chamber. However, during the intake and compression cycles, heat actually flows from the combustion chamber surfaces into the combustion chamber and fuel. With thick coatings, the higher surface temperature results in a greater temperature difference and increased heat transfer coefficient which causes a large amount of heat to flow from coating to the air and fuel during the intake cycle. This heat transfer increases the temperature and pressure of the mixture, and increases the compression work. In addition, this heat flow causes a reduction in volumetric efficiency which results in a decrease in specific power output. With the thin coating of the present invention, however, the overall chamber temperature is lower and results in less heat flow to the air and gas mixture during the intake cycle. This decreases compression work, increases volumetric efficiency, and increases specific power output.

The temperature of the combustion chamber walls varies throughout the engine cycle. The walls are coolest at the beginning of the compression stroke and hottest during the moment of combustion. If the walls are uninsulated (cast iron, for example), the wall surface temperature will only increase by about 18° C. (64° F.) during this time. For an insulated wall surface, the temperature increases by about 250° C. (482° F.) during the same period. However, as noted by D. N. Assanis and J. B. Heywood, in "Development and Use of a Computer Simulation of Turbocompounding Diesel System For Engine Performance and Component Heat Transfer Studies," S.A.E. 860329, 1986, this heat "swing" affects only the innermost 0.030 inch of an uninsulated wall, and the innermost 0.005 inch of a typical insulated wall.

The present invention thus solves the problems associated with thick coatings by maintaining a wide combustion chamber surface temperature swing through the engine cycle, which is indicative of heat retention and thermodynamic efficiency, while reducing the overall operating temperature of the combustion chamber, which reduces the aforementioned volumetric efficiency problems caused by excessive reversed heat flow. In addition, the thinner coating is far more reliable and durable, and therefore, less likely to fail.

DESCRIPTION OF THE PREFERRED EMBODIMENT

Figure 1:
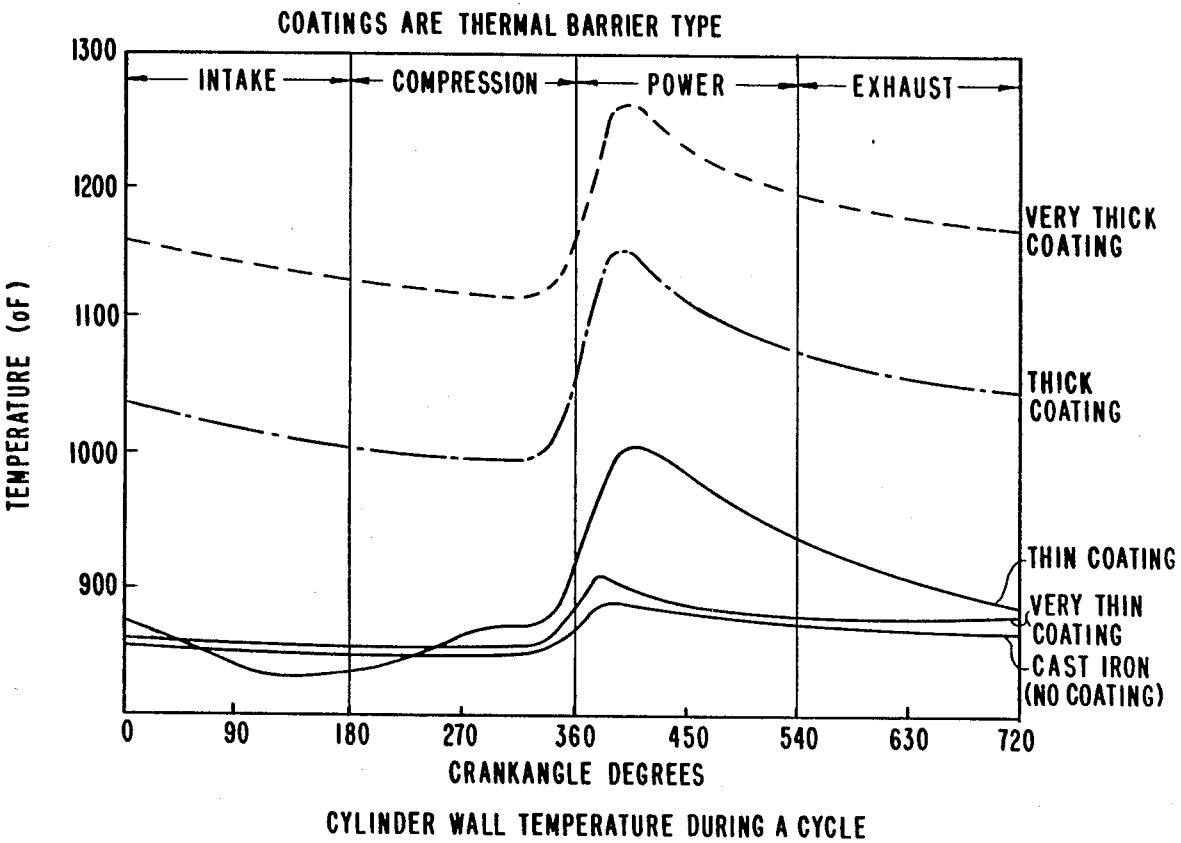
FIG. 1 is a graph showing the variation in combustion chamber temperatures for cast iron, very thinly coated, thinly coated, thickly coated, and very thickly coated combustion chambers.

FIG. 1 is a graph showing the variation in combustion chamber temperatures for cast iron, very thinly coated, thinly coated, thickly coated, and very thickly coated combustion chambers. With an uninsulated (cast iron) combustion chamber, the temperature throughout the engine cycle remains relatively constant due to a high rate of heat transfer through the chamber walls during the combustion cycle. This heat loss reduces overall engine efficiency. An engine having a very thin ceramic coating (0.0002 to 0.001 inch) such as that described in U.S. Pat. No. 4,074,671, increases overall engine temperature only slightly, and there is still a large amount of heat loss. An engine with a thick ceramic coating (0.050 inch, for example) greatly increases not only the average operating temperature, but also the temperature variation between the intake and combustion cycles. The engine power stroke operates more efficiently as indicated by the temperature rise during the power stroke, but the higher overall temperature causes problems such as lubrication breakdown, decreased volumetric efficiency, increased compression work, preignition, and knocking. A very thick coating (0.100 inch) increases the temperature throughout the cycle even more, which exacerbates these problems. However, even with a very thick coating, the temperature variation remains comparable to the thick coating.

The thin coating of the present invention (0.002 to 0.009 inch) also causes a large temperature rise during the power stroke, indicating thermodynamic efficiency. However, the overall operating temperature is much less than for a thick or very thick ceramic coating. Thus, the lubrication breakdown, decreased volumetric efficiency, increased compression, preignition, and knocking problems are eliminated.

Figure 2:
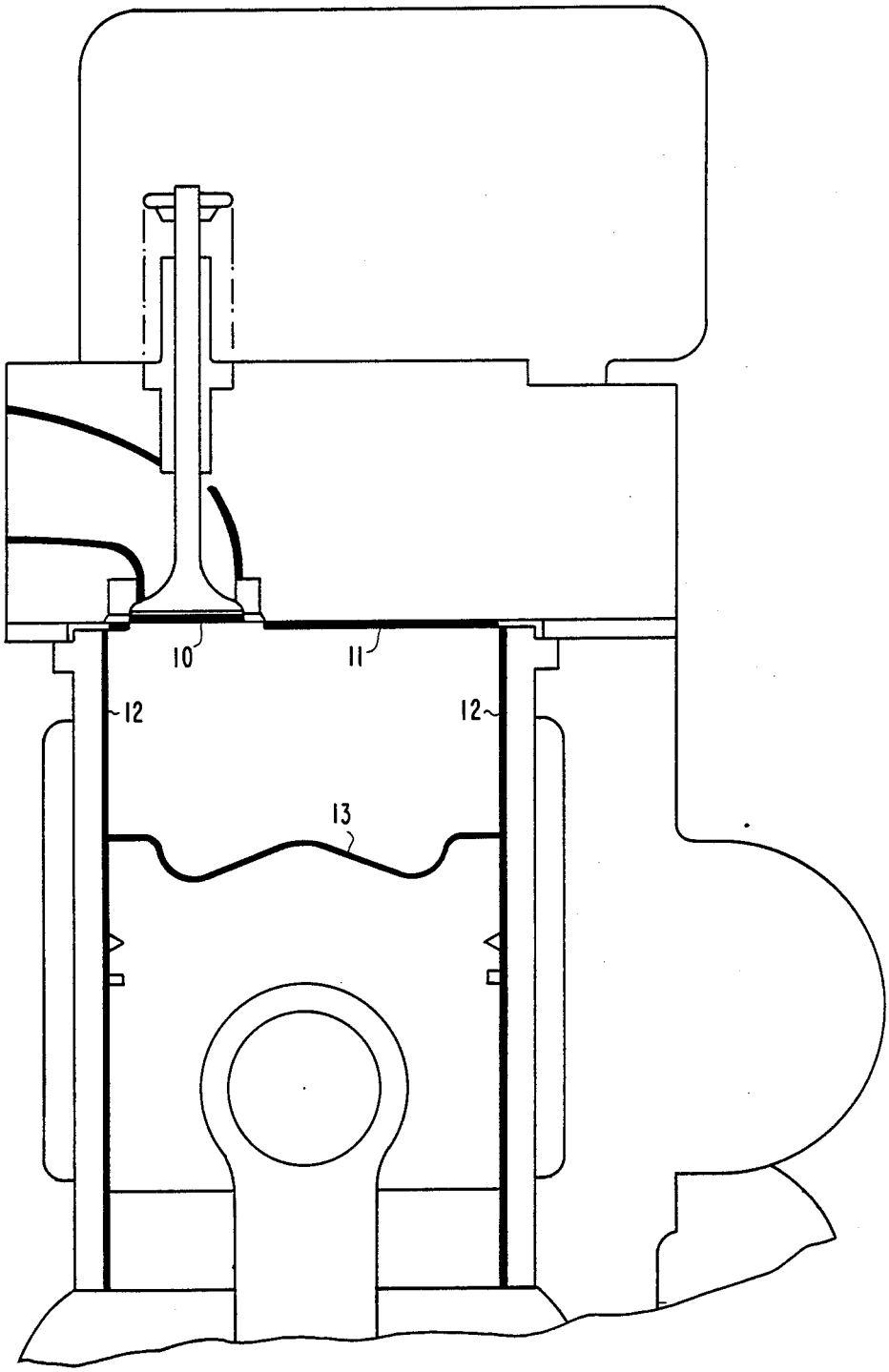
FIG. 2 is a section view of a combustion chamber of the present invention as applied to a typical piston engine.

FIG. 2 is a section view of a typical piston engine combustion chamber illustrating the present invention. The invention described herein is not limited to piston (diesel or gasoline) engines. It also can be applied to other internal combustion engines such as the Wankel Rotary. The thin ceramic coating of the invention may be placed on combustion chamber surfaces, including the valve face 10, headface 11, cylinder wall 12, and piston top 13. The combustion chamber surfaces may be comprised of cast iron, aluminum or any other desirable material. The application of the ceramic coating may be done by any technique well known in the art, such as by vapor deposition, sputtering, plasma spraying, drain casting, etc. The invention may also be practiced on other heat engines involving transient combustion phenomena such as Rotary Wankel, Stirling Cycle engines, etc.

The ceramic coating may consist of any of a number of well known ceramic compositions, and a binder may be applied between the metal substrate and the ceramic coating. The coating may also be densified with a substance having good durability characteristics such as chromium oxide, as described in Kamo, U.S. Pat. No. 4,495,907. In the preferred embodiment, a zirconium oxide based ceramic is used for its superior thermal barrier properties. A typical insulating coating thermal conductivity is 1.0 BTU/Hr.-Ft.°F. compared to iron at 20 and aluminum at 80.

Figure 3:
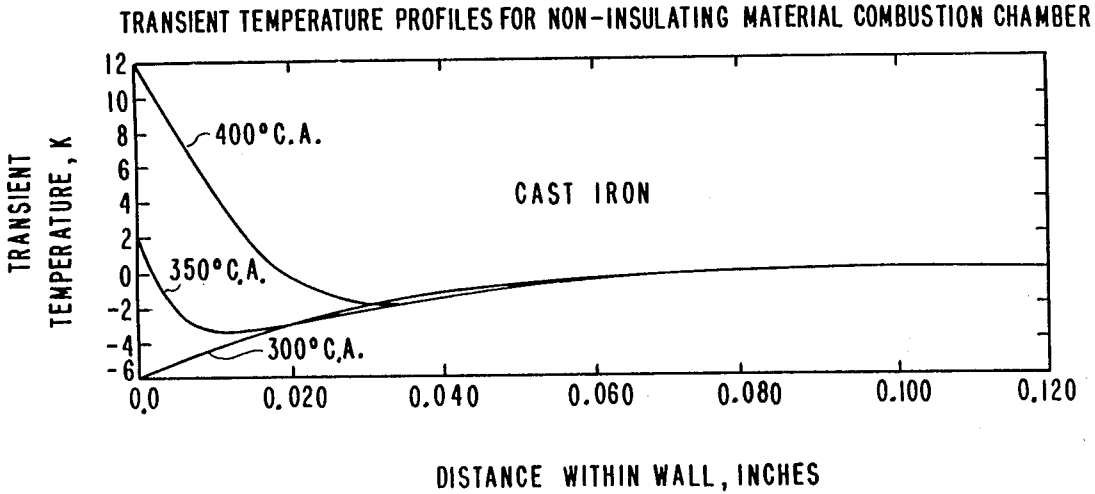
FIG. 3 is a graph showing the transient temperature profile in a cast iron cylinder wall throughout a typical engine cycle.

FIG. 3 is a graph showing the depth to which cyclic transient temperature and heat occurs in a cast iron cylinder wall. As iron is a good heat conductor, the temperature variations throughout the crank cycle affects about 0.030 inch depth of the cylinder wall. The graph illustrates the cross-sectional wall temperature profiles of three instances during an engine operating cycle: Intake (300° C.A.), Compression (350° C.A.), and Power (400°). The depth to which heat flow direction is induced is indicated by the temperature profiles (heat flows only from a high to a low temperature body). The depth to which transient heat flow occurs is dependent on the ability of the material to transfer heat energy. The amount of transient heat flow is proportional to the depth within the wall to which the temperature profile changes during the engine cycle. The most important fact demonstrated by this graph is that cylinder wall heat fluctuations affect only the first 0.030 inch of the cylinder wall.

Figure 4:
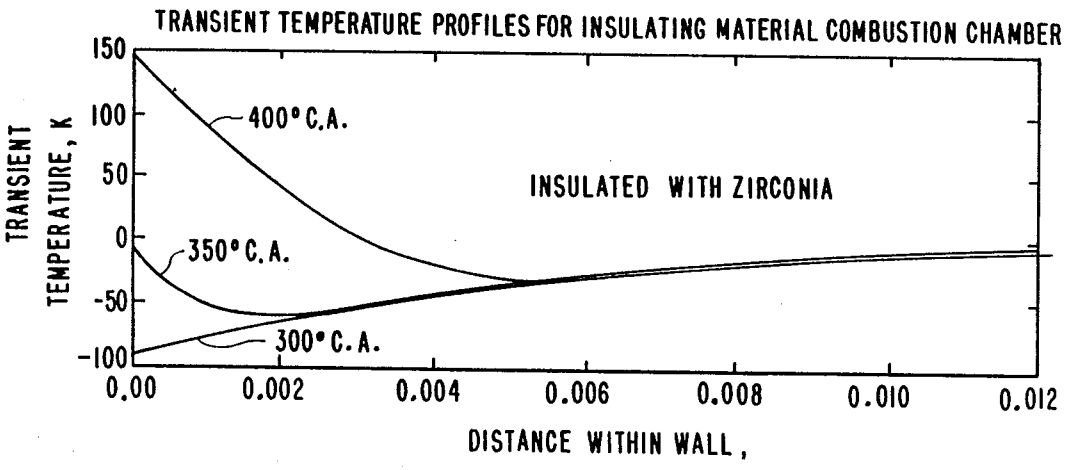
FIG. 4 is a graph showing the transient temperature profile in an insulated cylinder wall throughout a typical engine cycle.

FIG. 4 is a graph showing the depth to which cyclic transient temperature and heat flow occurs in a zirconia insulated cylinder wall. Heat fluctuations affect only 0.005 inch of the insulated wall, as opposed to 0.030 inch of the cast iron wall. This graph illustrates the important fact that a zirconia insulative coating greater than 0.005 inch does not materially affect the transient exchange of heat between the surface of the cylinder and the Parts of the cylinder deeper than 0.005 inch. This is true even though the overall operating temperature of the combustion chamber will be higher as the thickness of the insulative coating is increased, as illustrated by FIG. 1. It should also be noted that the exact depth of penetration of temperature fluctuation will depend on the particular insulative coating. FIG. 4 is representative of a coating comprised of a material with a thermal conductivity of 1.0 BTU/Hr.-Ft.°F. such as plasma sprayed zirconia.

Figure 5:
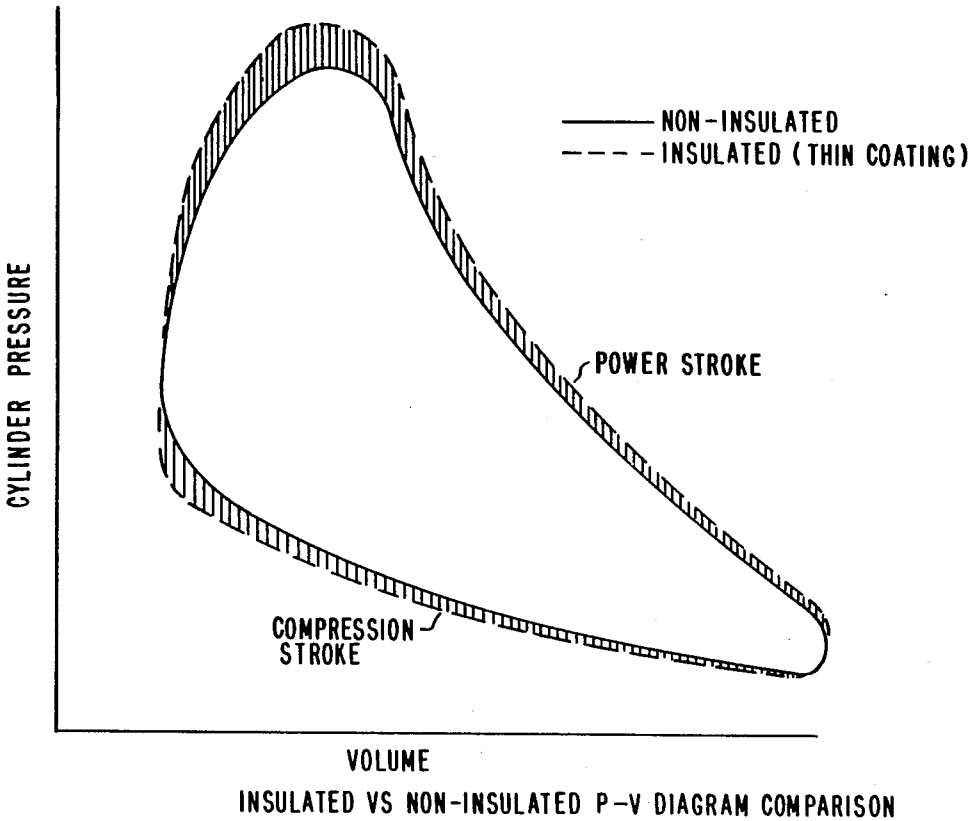
FIG. 5 is a cylinder pressure versus volume graph showing how insulating a combustion chamber effects power loss due to heat transfer from the combustion chamber to the working gas.

FIG. 5 is a cylinder pressure versus volume diagram showing how insulating a combustion chamber according to the present invention increases power output by reducing heat transfer from (1) the combustion chamber to the working gas during the compression stroke, and (2) from the working gas to the combustion chamber during the power stroke. During the compression stroke, insulation reduces heat flow from the cylinder walls to the working gas, and, in turn, reduces cylinder pressures. During the power stroke, the reduction of heat energy transfer from the working gas to the cylinder walls increases the cylinder pressure. The combined cylinder pressure characteristics resulting from the optimum level of insulation increases the area within the diagram shown in FIG. 5 and proportionally increases power output and thermal efficiency. Thus, it may be appreciated that the present invention allows an engine to operate at an optimum performance level by increasing combustion chamber temperature and pressure during the combustion cycle, and minimizing temperature and pressure during the remaining cycles. The increase in power output of the present invention over an uninsulated engine is represented by the hatched area in FIG. 5.

Figure 6:
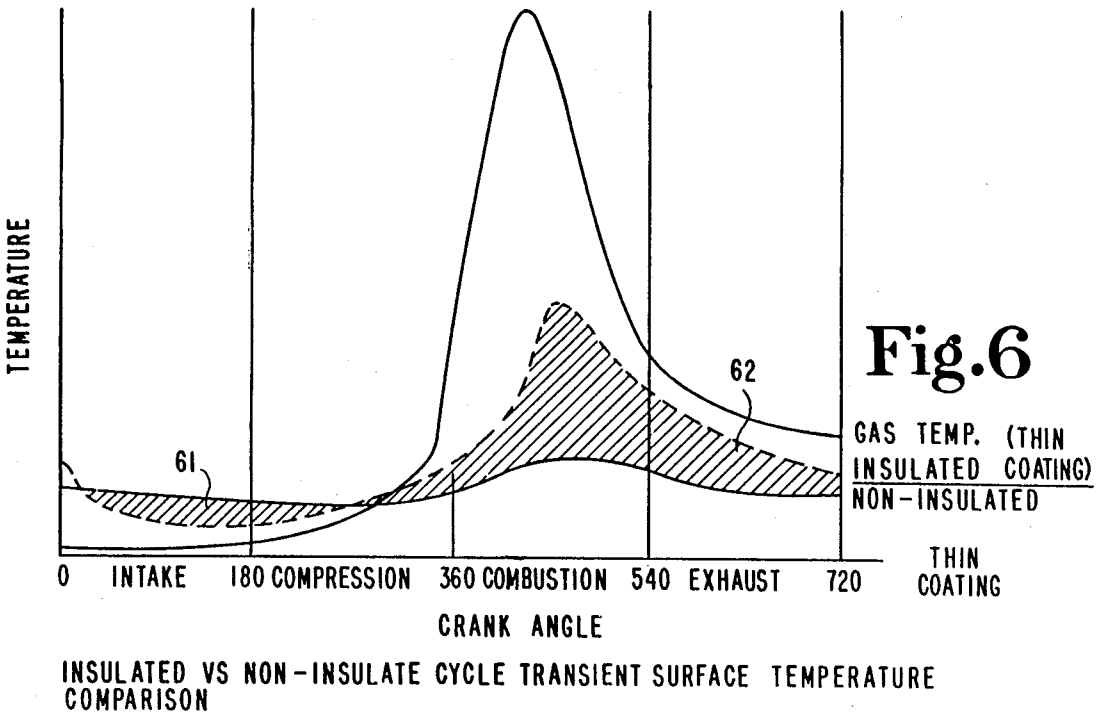
FIG. 6 is a graph showing how heat flow from combustion chamber walls to the working fluid affects the overall combustion chamber temperature throughout the engine cycle.

FIG. 6 is a graph showing how heat flow between combustion chamber walls and the working fluid effects the overall combustion chamber temperature throughout the engine cycle. The average temperature of the chamber for an uninsulated chamber is lower than for an insulated chamber. However, during the intake cycle and the first part of the compression cycle, the temperature of the thin coating insulated chamber is actually lower for the uninsulated engine. This is because during this period, an uninsulated chamber transfers heat to the working fluid. In a thin coating insulated chamber, however, the insulating material prevents the transfer of heat from the metal substrate through the insulating material to the working fluid. The difference in heat flow between the insulated and uninsulated chamber is proportional to the shaded portions 61 and 62. The portion identified by 61 is representative of the reduction in heat flow from the cylinder surface to the working gas which is derived from optimum insulation. The portion identified by 62 is representative of the reduction in heat flow from the working gas to the cylinder surface which is derived from optimum insulation.

We claim:

1. An internal combustion engine combustion chamber component having on a surface thereof a layer of thermally insulative material of a thickness of approximately 0.002 inch to 0.009 inch.

2. The combustion chamber component of claim 1 wherein said insulative material has particles of chromium oxide dispersed at least partially therewithin.

3. The combustion chamber component of claim 1 wherein said insulative material comprises a refractory oxide.

4. The combustion chamber component of claim 3 wherein said insulative material comprises zirconia.

5. The combustion chamber component of claim 4 wherein said insulative material has particles of chromium oxide dispersed at least partially therewithin.

6. The combustion chamber component of claim 1 wherein said insulative material is selected from the group consisting of CrC, HfC, NbC, TaC, TiN, CrN, HfN, NbN, TaN, TiN, $Cr_2O_3$, $HfO_2$, $Nb_2O_3$, $Ta_2O_5$, and $TiO_2$.

7. The combustion chamber component of claim 1 further comprising a binder disposed between the surface of the component and the layer of thermally insulative material.

8. The combustion chamber component of claim 1, wherein the combustion chamber component to which the insulative material is attached is comprised of aluminum.

* * * * *